US008369986B2

(12) United States Patent
Doi

(10) Patent No.: US 8,369,986 B2
(45) Date of Patent: Feb. 5, 2013

(54) PAPER SHEET HANDLING APPARATUS

(75) Inventor: Kazuhiro Doi, Hyogo (JP)

(73) Assignee: Glory Ltd., Hime-Shi, Hyogo (JP)

( * ) Notice: Subject to any disclaimer, the term of this patent is extended or adjusted under 35 U.S.C. 154(b) by 69 days.

(21) Appl. No.: 12/735,935

(22) PCT Filed: Feb. 27, 2008

(86) PCT No.: PCT/JP2008/000365

§ 371 (c)(1),
(2), (4) Date: Aug. 26, 2010

(87) PCT Pub. No.: WO2009/107165

PCT Pub. Date: Sep. 3, 2009

(65) Prior Publication Data

US 2011/0004337 A1 Jan. 6, 2011

(51) Int. Cl.
*B65H 39/00* (2006.01)

(52) U.S. Cl. ..... 700/223; 270/58.18; 270/58.2; 270/58.33; 270/58.34

(58) Field of Classification Search ..... 270/58.18, 270/58.2, 58.33, 58.34; 221/12; 209/534; 271/306; 312/287; 700/223
See application file for complete search history.

(56) References Cited

U.S. PATENT DOCUMENTS

| | | | | |
|---|---|---|---|---|
| 4,362,112 | A | 12/1982 | Uchida | 109/19 |
| 4,577,763 | A | 3/1986 | Placke et al. | 209/534 |
| 4,699,272 | A | 10/1987 | Kokubo et al. | 209/534 |
| 5,628,258 | A | 5/1997 | Zwahlen et al. | 109/45 |
| 6,328,166 | B1 | 12/2001 | Sakai | 209/534 |
| 6,771,180 | B2 * | 8/2004 | Mizuta et al. | 340/674 |
| 7,040,476 | B2 | 5/2006 | Sugano et al. | 194/206 |
| 2009/0184034 | A1 * | 7/2009 | Doi et al. | 209/534 |
| 2010/0017018 | A1 * | 1/2010 | Morino et al. | 700/223 |
| 2010/0032352 | A1 * | 2/2010 | Ozaki et al. | 209/534 |

FOREIGN PATENT DOCUMENTS

| | | |
|---|---|---|
| EP | 1 184 817 A2 | 3/2002 |
| JP | 1-79174 | 5/1989 |
| JP | 05-298522 | 11/1993 |
| JP | 2003-30714 | 1/2003 |

OTHER PUBLICATIONS

European Search Report (dated Feb. 15, 2011—5 pages).

* cited by examiner

*Primary Examiner* — Leslie A Nicholson, III
(74) *Attorney, Agent, or Firm* — Renner, Kenner, Greive, Bobak, Taylor & Weber

(57) ABSTRACT

A paper sheet handling apparatus 1 includes: a casing which includes a first face and a second face opposed to the first face; a receiving unit 211 which receives paper sheets; a recognition unit 212 which performs at least one of a counting process and a recognition process with respect to the paper sheets; at least two stacking units 31-34 which stack the paper sheets after processing in the recognition unit 212; a transport unit 4 for transporting the paper sheets among the receiving unit 211, the recognition unit 212 and the stacking units 31-34; and a controller which controls each of the units, thereby having each of the paper sheets selectively stacked in the stacking units 31-34. Each of the stacking units 31-34 has at least two paper sheet removal openings 3L, 3R which are open in the first face and the second face. The paper sheets in the stacking units 31-34 are allowed to be removed through the paper sheet removal openings 3L, 3R, from the first face side and the second face side of the casing.

6 Claims, 9 Drawing Sheets

PAPER SHEET HANDLING APPARATUS

TECHNICAL FIELD

The present invention relates to paper sheet handling apparatuses for handling paper sheets such as banknotes, checks or tickets.

BACKGROUND ART

For example, in many cases, a banknote handling machine as a paper sheet handling apparatus which can be shared for use by two tellers is placed at a teller counter to save space. Patent Document 1 discloses a depositing and dispensing machine as an example of such an apparatus. The depositing and dispensing machine is an apparatus that is shared for use by two tellers, right and left, with the apparatus located between the two tellers, and is designed to be symmetric from side to side. Specifically, the apparatus includes operation units at right and left end portions of the casing. If the operation unit on the left side is operated, the teller on the left side can occupy the depositing and dispensing machine. On the other hand, if the operation unit on the right side is operated, the teller on the right side can occupy the depositing and dispensing machine. This structure improves the usability of the apparatus for both of the tellers on the right and left sides of the apparatus.

The depositing and dispensing machine includes, in its interior, a depositing unit into which banknotes are deposited, a recognition unit which performs a counting process and a recognition process for the banknotes, an escrow unit for temporarily holding the banknotes after the recognition process, a storage unit for storing the banknotes that have been held in the escrow unit after an operation for accepting the deposit of the banknotes, and a dispensing unit from which the banknotes fed from the storage unit are dispensed at the time of a dispensing process.

A depositing process of the depositing and dispensing machine goes through the following steps. That is, banknotes are deposited in the depositing unit first. Then, an operation for starting a predetermined depositing process is conducted. This operation allows the banknotes deposited in the depositing unit to be fed one by one, and the banknotes are subjected to a recognition process and a counting process in the recognition unit. The banknotes after the recognition process are held in the escrow unit. When the operation for accepting the deposit of the banknotes is conducted after all the banknotes deposited in the depositing unit have been fed and held in the escrow unit, the banknotes held in the escrow unit will be stored in the storage unit. This is the end of the depositing process.

In the depositing and dispensing machine of this type, the escrow unit may become full if a teller deposits a large amount of banknotes at a time. In this case, the following problems occur in the conventional depositing and dispensing machines. That is, if the escrow unit becomes full, it is not possible to continue the process and therefore the banknotes in the escrow unit need to be stored in the storage unit by, for example, performing a predetermined operation. Further, even if the banknotes are stored in the storage unit, once the storage unit becomes full, the teller has to open the casing so that the storage unit is exposed to the outside, and has to remove the banknotes stored in the storage unit.

As described, to process a large amount of banknotes by a device which has, in its casing, an escrow unit and a storage unit, i.e., a stacking unit for the banknotes, the teller has to do some operation with the apparatus every time the stacking unit becomes full. This operation is troublesome. Moreover, the process is interrupted every time the stacking unit becomes full. Thus, the process requires a longer time.

Such an interruption of the process may result in extending the waiting time of the clients, and moreover, may lead to a decrease in efficiency of work at the counter.

For example, Patent Document 2 discloses a banknote sorter having a receiving unit, a recognition unit, and a stacking unit for stacking the banknotes received in the receiving unit and subjected to a recognition process. In this apparatus, unlike the above-mentioned depositing and dispensing machine, the stacking unit is open toward the outside of the casing, and the banknotes stacked there can be easily removed by hand. Thus, to handle a large amount of banknotes by this apparatus, the banknotes stacked in the stacking unit are removed by hand before the stacking unit becomes full, or soon after the stacking unit becomes full. Therefore, interruption of the process can be avoided, or even if the process is interrupted, the process can be restarted easily, thereby reducing the interruption to a minimum.

This banknote sorter too is designed for use from both right and left sides of the apparatus. Specifically, for example, start/stop keys are located at the left end and the right end of the casing. Thus, tellers on both sides of the device can handle the apparatus. Further, the stacking unit is positioned at a generally central location of the apparatus, which makes it possible for the tellers on both sides of the apparatus to remove the banknotes. However, although the stacking unit can be locked when needed, the teller on the other side may erroneously take the banknotes stacked in the stacking unit because the stacked banknotes can be easily removed from both sides of the apparatus. Thus, in this banknote sorter, although the efficiency of the process can be improved because of the structure in which the stacking unit is open, it is impossible to completely prevent the tellers from erroneously removing the banknotes.

For example, Patent Document 3 discloses, as a depositing and dispensing machine shared for use by two tellers, an apparatus which indicates, in different colors, permission and prohibition of the deposition and removal of banknotes to each of the teller on the left side and the teller on the right side. These instructions in different colors may draw attention of the tellers, but it is impossible to completely prevent the tellers from erroneously removing the banknotes.

Further, for example, Patent Document 4 discloses a depositing and dispensing machine having a sensor which detects a direction of removal of banknotes when the banknotes are removed through a banknote outlet. If the teller on the other side erroneously removes the banknotes, an alarm is given based on the detection result, thereby alerting the teller that the banknotes are erroneously removed. However, depending on the direction of the removal of banknotes (e.g., if the banknotes are not removed in a diagonally right direction or a diagonally left direction, but are removed straight), it is not possible to determine whether the banknotes are erroneously removed or not from the detection by the sensor. Thus, it is impossible to completely prevent the tellers from erroneously removing the banknotes in this apparatus as well.

CITATION LIST

Patent Document

PATENT DOCUMENT 1: Japanese Patent Publication No. 2003-30714

PATENT DOCUMENT 2: Japanese Patent Publication No. 2000-259882

PATENT DOCUMENT 3: Japanese Patent Publication No. H05-298522

PATENT DOCUMENT 4: Japanese Utility Model Publication No. H01-79174

SUMMARY OF THE INVENTION

Technical Problem

The present invention was made in view of the above problems, and it is an objective of the invention to provide a paper sheet handling apparatus which can be shared for use by two operators and which can improve efficiency particularly in handling a large amount of paper sheets. Another objective of the invention is to provide a paper sheet handling apparatus in which paper sheets are not erroneously removed when the two operators on the left and right sides of the apparatus share the apparatus.

Solution to the Problem

According to the first aspect of the present invention, a paper sheet handling apparatus includes: a casing which includes a first face and a second face opposed to the first face; a receiving unit which includes an inlet for receiving the paper sheets, and a feed mechanism for feeding the paper sheets received in the inlet, one by one; a recognition unit for performing at least one of a counting process and a recognition process with respect to each of the paper sheets received in the inlet; at least two stacking units for stacking the paper sheets that have been processed by the recognition unit; a transport unit for transporting the paper sheets among the receiving unit, the recognition unit and the stacking units; and a controller for controlling each of the units so that each of the paper sheets is selectively stacked in the at least two stacking units, wherein each stacking unit is configured to include at least two paper sheet removal openings which are open in the first face and the second face, respectively, and the paper sheets in the stacking units are allowed to be removed from the first face side and the second face side of the casing through the paper sheet removal openings.

According to this structure, the paper sheets that have been received in the receiving unit and recognized by the recognition unit are selectively transported to the at least two stacking units and stacked there. Here, each of the stacking units has at least two paper sheet removal openings which are open in the first face and the second face. The paper sheets in the stacking units can be removed from the first face side and the second face side of the casing through the paper sheet removal openings. With this structure, the paper sheet handling apparatus is easily shared for use by two operators on the first face side and the second face side.

Further, owing to the structure in which the stacking units are open, the paper sheets stacked in the stacking units can be removed by hand before the stacking units become full, or soon after the stacking units have become full. Thus, interruption of the process can be avoided, or if the process is interrupted, the process can be restarted easily, thereby reducing the interruption to a minimum. As a result, efficiency in handling a large amount of paper sheets is particularly improved.

According to another aspect of the present invention, a paper sheet handling apparatus includes a casing which includes a first face and a second face opposed to the first face; a receiving unit which includes an inlet for receiving the paper sheets, and a feed mechanism for feeding the paper sheets received in the inlet, one by one; a recognition unit for performing at least one of a counting process and a recognition process with respect to each of the paper sheets received in the receiving unit; at least two stacking units for stacking the paper sheets that have been processed by the recognition unit; a transport unit for transporting the paper sheets among the receiving unit, the recognition unit and the stacking units; and a controller for controlling each of the units so that each of the paper sheets is selectively stacked in the at least two stacking units, wherein the stacking units are configured to include at least one stacking unit of a first type which has a paper sheet removal opening open in the first face, and at least one stacking unit of a second type which has a paper sheet removal opening open in the second face, and the paper sheets in the stacking unit of the first type are allowed to be removed from a first face side of the casing through the paper sheet removal opening open in the first face, and the paper sheets in the stacking unit of the second type are allowed to be removed from a second face side of the casing through the paper sheet removal opening open in the second face.

According to this structure, the paper sheets received in the receiving unit and recognized by the recognition unit are selectively transported to the at least two stacking units and stacked there. Here, the stacking units include a stacking unit of a first type which has a paper sheet removal opening open in the first face, and a stacking unit of a second type which has a paper sheet removal opening open in the second face. The paper sheets in the stacking unit of the first type can be removed from the first face side of the casing, and the paper sheets in the stacking unit of the second type can be removed from the second face side of the casing. The paper sheets received in the inlet by the operator on the first face side are stacked in the stacking unit of the first type, whereas the paper sheets received in the inlet by the operator on the second face side are stacked in the stacking unit of the second type. With this structure, the paper sheet handling apparatus can be shared for use by the two operators on the first face side and the second face side of the apparatus.

Further, owing to the structure in which the stacking units are open, the paper sheets stacked in the stacking units can be removed by hand before the stacking units become full, or soon after the stacking units have become full. Thus, interruption of the process can be avoided, or if the process is interrupted, the process can be restarted easily, thereby reducing the interruption to a minimum. As a result, efficiency in handling a large amount of paper sheets is particularly improved.

The stacking units are open as described above. However, the stacking unit of the first type is not open toward the second face side, and therefore, it is difficult to remove the paper sheets stacked in the stacking unit of the first type from the second face side. On the other hand, it is difficult to remove the paper sheets stacked in the stacking unit of the second type from the first face side. Thus, the paper sheet handling apparatus can be easy shared for use by the two operators. At the same time, the paper sheet handling apparatus prevents the operator on the other side from erroneously removing the paper sheets in the stacking units.

The apparatus may further include a restriction mechanism for restricting a direction of removal of the paper sheets in the stacking units, to a direction from the first face side or a direction from the second face side.

The restriction mechanism prevents the paper sheets in a stacking unit from being erroneously removed by the operator on the other side.

The apparatus may further include an instruction mechanism for instructing whether the direction of removal of the paper sheets in the stacking units is from the first face side or from the second face side, and may be configured such that according to a result of the instruction from the instruction mechanism, the paper sheets are allowed to be removed from the side that has been instructed.

In this structure, for example, an instruction about the removal direction may be given by the operator who sets the paper sheets in the inlet, thereby making it possible to remove the paper sheets in the stacking units from the first face side or the second face side. Thus, the paper sheet handling apparatus prevents the operator on the other side from erroneously removing the paper sheets in the stacking units.

The receiving unit may include a receiving part for the first face side and a receiving part for the second face side, and the paper sheets received in the receiving part for the first face side are allowed to be removed from the first face side, and the paper sheets received in the receiving part for the second face side are allowed to be removed from the second face side.

With this structure, if the operator on the first face side places paper sheets in the receiving part for the first face side, the operator on the first face side is allowed to remove the paper sheets, whereas if the operator on the second face side places paper sheets in the receiving part for the second face side, the operator on the second face side is allowed to remove the paper sheets. Thus, the paper sheet handling apparatus prevents the operator on the other side from erroneously removing the paper sheets in the stacking units.

The apparatus may further include an operation unit for the first face side and an operation unit for the second face side.

In this structure, operation of the paper sheet handling apparatus becomes possible by the operator on the first face side of the apparatus and the operator on the second face side of the apparatus who operate the operation unit for the first face side and the operation unit for second face side, respectively. Thus, the usability of the paper sheet handling apparatus that is shared for use by two operators improves.

The apparatus may further include a display unit for the first face side and a display unit for the second face side.

In this structure, information regarding the paper sheet handling apparatus can be obtained by the operator on the first face side of the device and the operator on the second face side of the device who watch the display unit for the first face side and the display unit for the second face side, respectively. Thus, the usability of the paper sheet handling apparatus that is shared for use by two operators improves.

Advantages of the Invention

According to the present invention, operators on both the first face side and the second face side, with an apparatus interposed between each other, can share the apparatus. In addition, since a stacking unit is open, it is possible to increase the efficiency particularly in handling a large amount of paper sheets. Moreover, since a direction of removal of paper sheets is restricted, it is possible to prevent an erroneous removal of paper sheets when the apparatus is shared for use by the two operators.

DESCRIPTION OF REFERENCE CHARACTERS

Figure 1A:
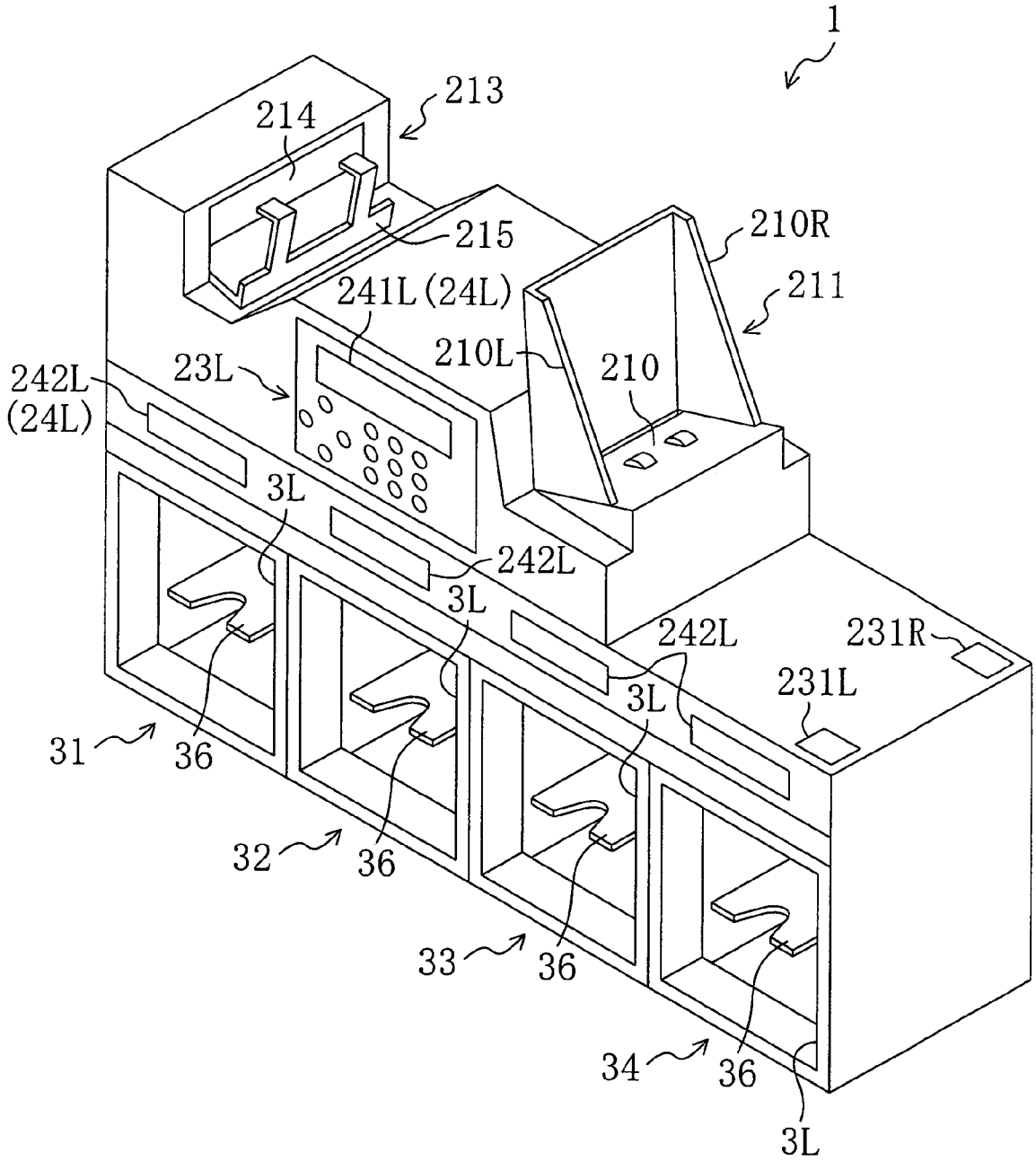
FIG. 1A is an oblique view illustrating an entire structure of a banknote processing machine viewed from the left.
Figure 1B:
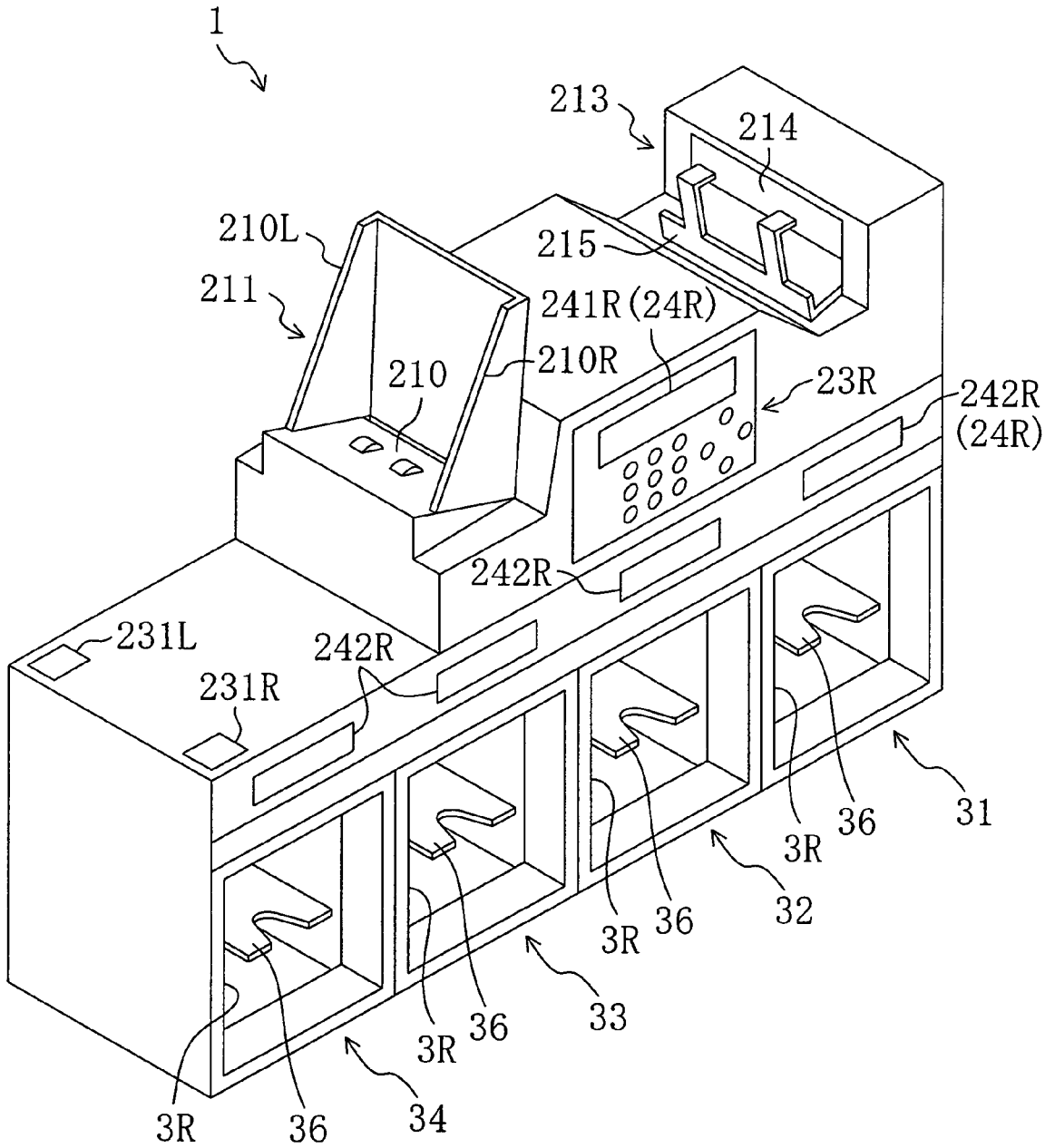
FIG. 1B is an oblique view illustrating the entire structure of the banknote processing machine viewed from the right.

1 banknote processing machine (paper sheet handling apparatus)
10 banknote processing machine (paper sheet handling apparatus)
210 hopper (inlet)
211 inlet unit (receiving unit)
211L left inlet unit
211R right inlet unit
212 recognition unit
23 operation unit
23L left operation unit
23R right operation unit
231L left occupying switch
231R right occupying switch
24 display unit
24L left display unit
24R right display unit
241L display unit for left side operation
241R display unit for right side operation
242L display unit for left removal opening
242R display unit for right removal opening
25 controller
3 stacking unit
3L left removal opening (paper sheet removal opening)
3R right removal opening (paper sheet removal opening)
31 stacker (stacking unit)
32 stacker (stacking unit)
33 stacker (stacking unit)
34 stacker (stacking unit)
35 shutter
4 transport unit

DESCRIPTION OF EMBODIMENTS

Embodiments of a banknote processing machine which is a type of paper sheet handling apparatus according to the present invention will be described in detail with reference to the drawings. The following descriptions of the preferable embodiments are merely preferred examples in nature, and are not intended to limit the scope, applications, and use of the invention. The paper sheet handling apparatus does not only handle banknotes, but also can handle paper sheets in general, such as checks and tickets as well as banknotes.

FIGS. 1A, 1B, 2A and 2B are oblique views of a banknote processing machine (hereinafter simply referred to as "processing machine" as well) 1 as a paper sheet handling apparatus. The processing machine in FIG. 1 and the processing machine in FIG. 2 are different from each other in that doors 35 are provided or not to removal openings 3L, 3R on the left and right sides of each of stackers 31-34, described later. The doors 35 are the members which can be added to the processing machine 1. In the following description, the processing machine 1 which has the doors 35 will be described. However, except the description about the doors 35, descriptions are the same between the processing machine 1 which has the doors 35 and the processing machine 1 which does not have the doors 35.

Figure 3:
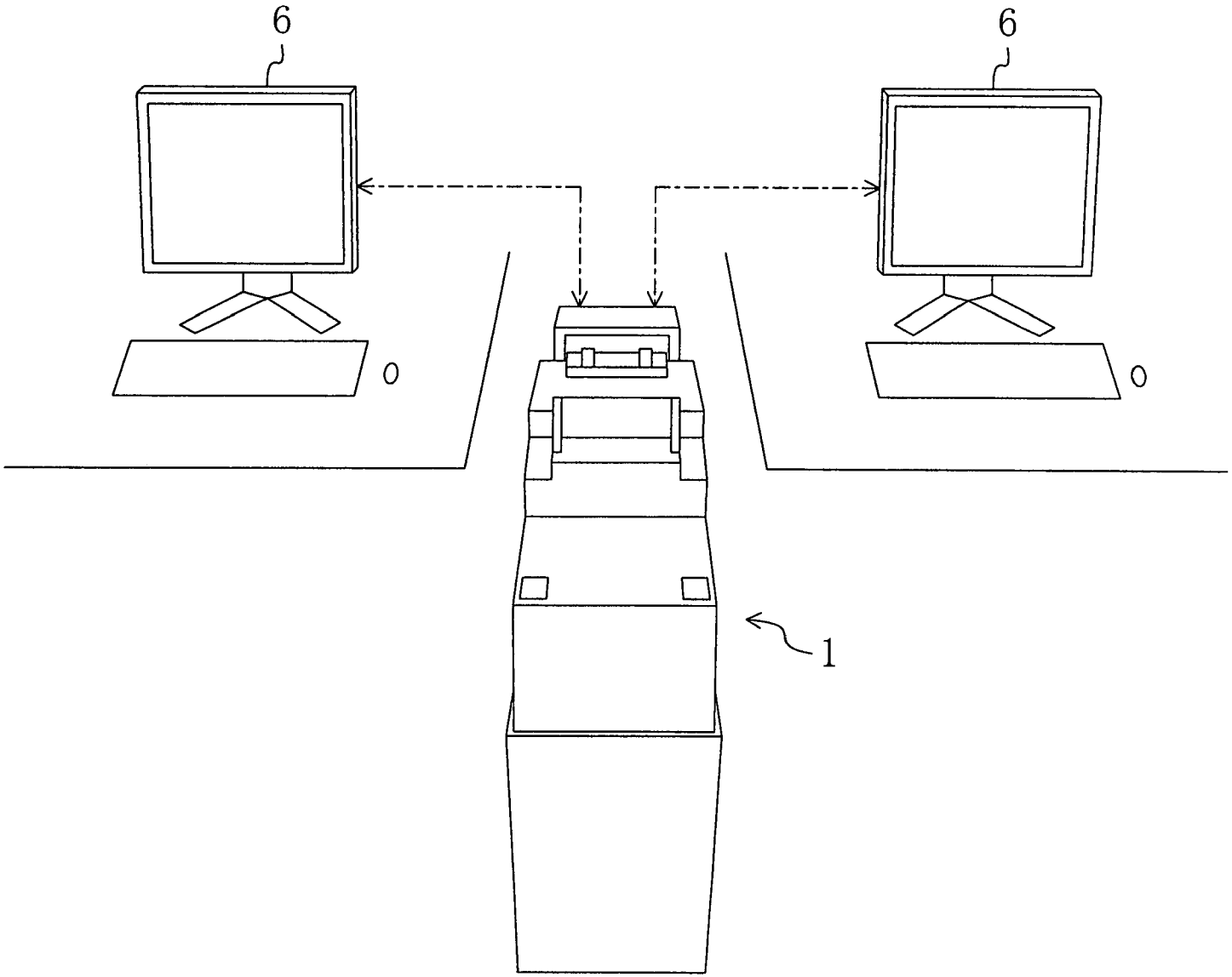
FIG. 3 is an oblique view illustrating a situation where the banknote processing machine is used.

The processing machine 1 is an apparatus which sorts a mixture of banknotes including a plurality of denominations, according to the denominations and/or according to whether the banknotes are fit or unfit, and/or whether the banknotes are genuine or counterfeit, for example. The processing machine 1 also counts and arranges the sorted banknotes. As shown in FIG. 3, the processing machine 1 is placed, for example, at a teller counter of a bank, and is shared for use by two tellers on the left and right sides of the processing machine 1. Thus, two teller terminals 6, 6 operated by the tellers on the left and right sides of the processing machine 1 are connected to the processing machine 1. The tellers use the processing machine 1 by operating the respective teller terminals 6.

As shown in FIGS. 2-5, the processing machine 1 includes: an inlet unit 211 as a receiving unit having, as an inlet, a hopper 210 which receives banknotes; a recognition unit 212 for recognizing the banknotes; a reject unit 213 which returns banknotes based on a recognition result by the recognition unit 212; a stacking unit 3 which stacks the banknotes after the recognition; and a transport unit 4 which includes a transport path connecting the inlet unit 211, the recognition unit 212, the reject unit 213 and the stacking unit 3 to each other, and which transports banknotes in a long edge feed along the transport path.

The processing machine 1 also includes: a communication unit 22 which transmits data between the teller terminals 6, 6 via a communication line; an operation unit 23 operated by a teller; a display unit 24 which displays various information; and a controller 25 which controls each of the units 211-213, 22-24, 3 and 4.

The hopper 210 is an opening in which a plurality of stacked banknotes are set. As shown in FIG. 2, the hopper 210 is positioned at a location on the upper face of the casing which is in the middle of the left to right dimension and which is generally in the middle of the length dimension, and is horizontally open upward. A guide plate for guiding the set banknotes is attached to the hopper 210. Left and right side walls 210L, 210R of the guide plate are diagonally cut. This structure enables the banknotes to be easily set in the hopper 210 from both left and right sides of the processing machine 1.

The inlet unit 211 also has a feed mechanism which feeds, one by one, the plurality of banknotes set in the hopper 210.

The recognition unit 212 is capable of recognizing the denomination of each banknote fed from the inlet unit 211, whether the banknote is genuine or counterfeit, and whether the banknote is fit or unfit. Further, the recognition unit 212 counts the banknotes. In the case where the processing machine 1 is configured to be able to handle currencies of different countries, the recognition unit 212 may be configured to recognize the kinds of the currencies.

The reject unit 213 is a unit to which a banknote having been considered impossible to process by the recognition unit 212 (e.g., an unfit note) is transported and which returns the unfit note or the like to the user. The reject unit 213 is positioned at a location on the upper face of the casing which is in the middle of the width dimension and which is at the rear portion of the length dimension. The reject unit 213 has an outlet 214 that is open toward the front.

A mounting plate 215 on which the banknotes delivered through the outlet 214 are mounted is attached to the outlet 214. The mounting plate 215 is open on both left and right sides of the banknotes mounted on the mounting plate 215. With this structure, the banknotes mounted on the mounting plate 215 are easily removed from both left and right sides of the processing machine 1.

The stacking unit 3 is configured to include the first to fourth stackers (stacking units) 31-34 which are provided in a lower portion of the casing and arranged next to each other along the length dimension. Banknotes are selectively stacked in these stackers in accordance with a predetermined sort configuration, such as a difference in denominations and/or whether the banknotes are fit or unfit, based on the recognition result by the recognition unit 212. Specifically, for example, banknotes of different denominations may be respectively stacked in the first to fourth stackers 31-34, or banknotes of the same denomination may be sorted into a plurality of stackers. For example, banknotes of a predetermined denomination may be stacked in the first and the second stackers 31, 32; banknotes of another denomination may be stacked in the third stacker 33; and banknotes of a denomination different from the other denominations may be stacked in the fourth stacker 34. The number of stackers included in the stacking unit 3 is not limited to four, but the number of the stackers can be freely determined.

Figure 4:
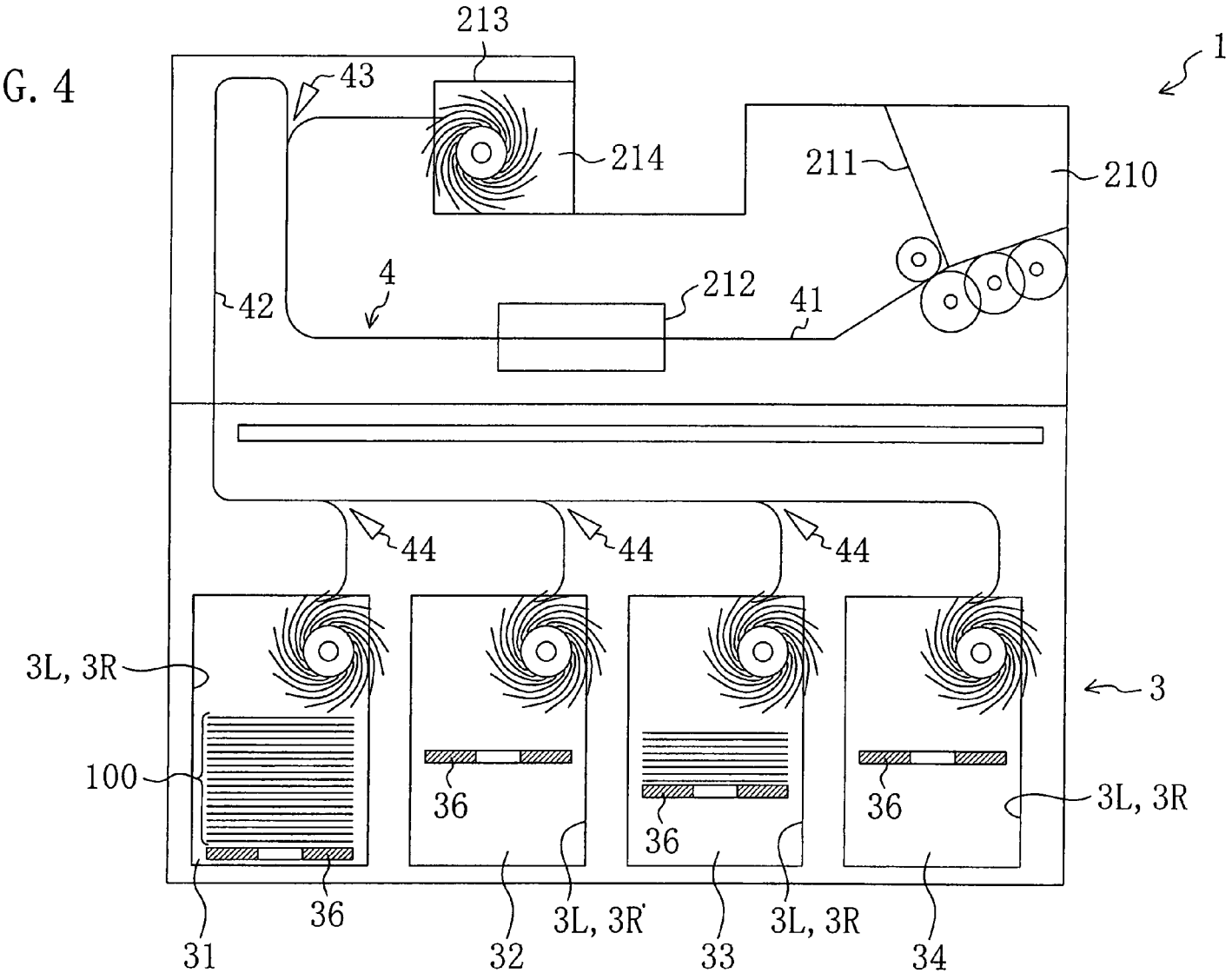
FIG. 4 is a schematic view illustrating an internal structure of the banknote processing machine.
Figure 5:
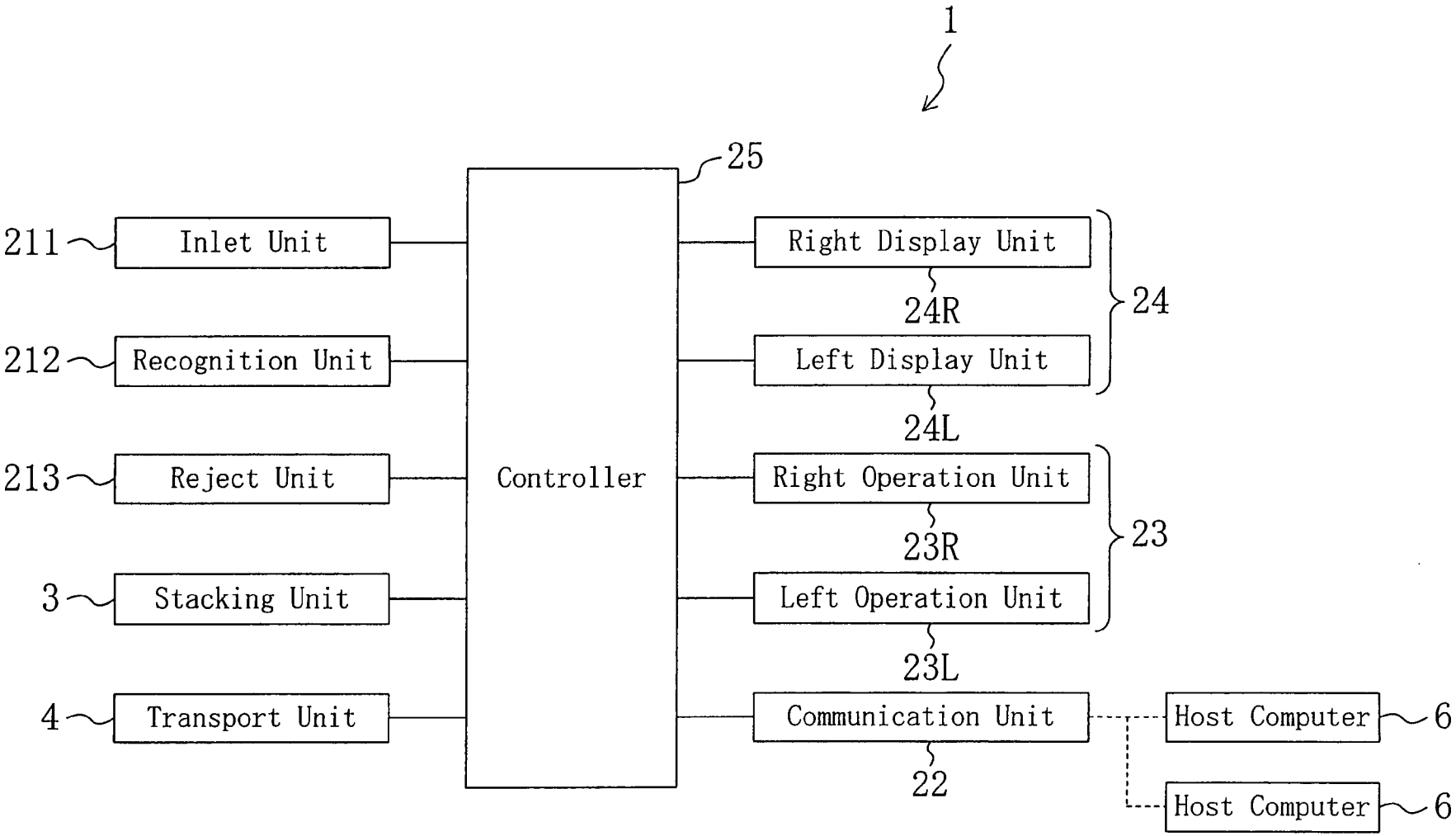
FIG. 5 is a block diagram illustrating a structure relating to control of the banknote processing machine.

As schematically illustrated in FIG. 4, each of the stackers 31-34 has a stacking space in which banknotes 100 are stacked and accumulated vertically. As shown in FIG. 2, the stacking space is open outward through a left removal opening 3L and a right removal opening 3R, which respectively open toward the left side and the right side of the casing. With this structure, the banknotes stacked in each of the stackers 31-34 can be easily removed from the left side of the processing machine 1 through the left removal opening 3L, and can be easily removed from the right side of the processing machine 1 through the right removal opening 3R.

A stage 36, which is movable in a vertical direction by being suspended by a spring or driven by a motor, is provided in the stacking space of each stacker 31-34. The banknotes 100 are mounted and stacked on the stage 36. The stage 36 moves down from its initial position according to the amount of banknotes mounted on the stage 36.

Figure 2A:
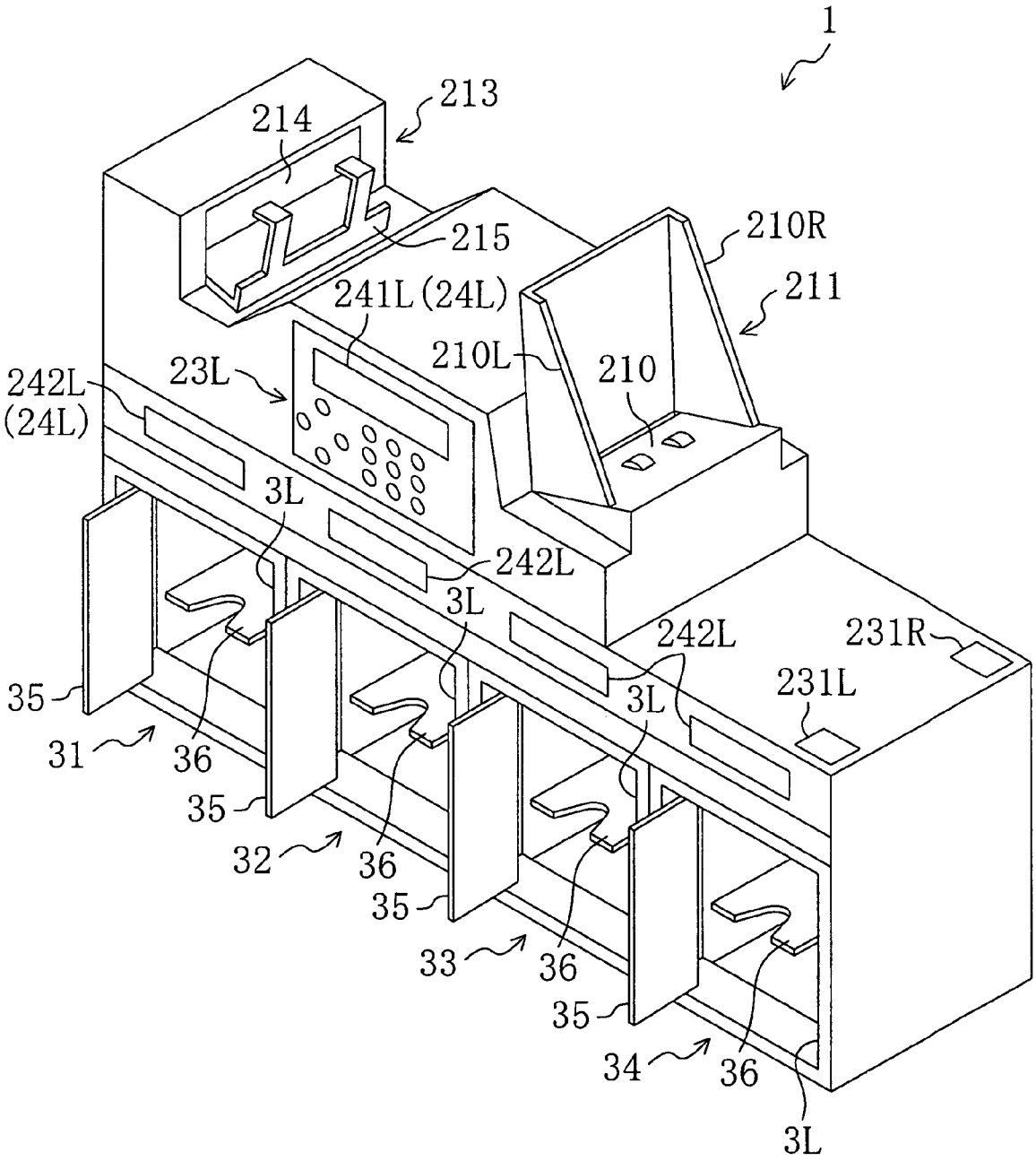
FIG. 2A is an oblique view illustrating an entire structure of a banknote processing machine viewed from the left.
Figure 2B:
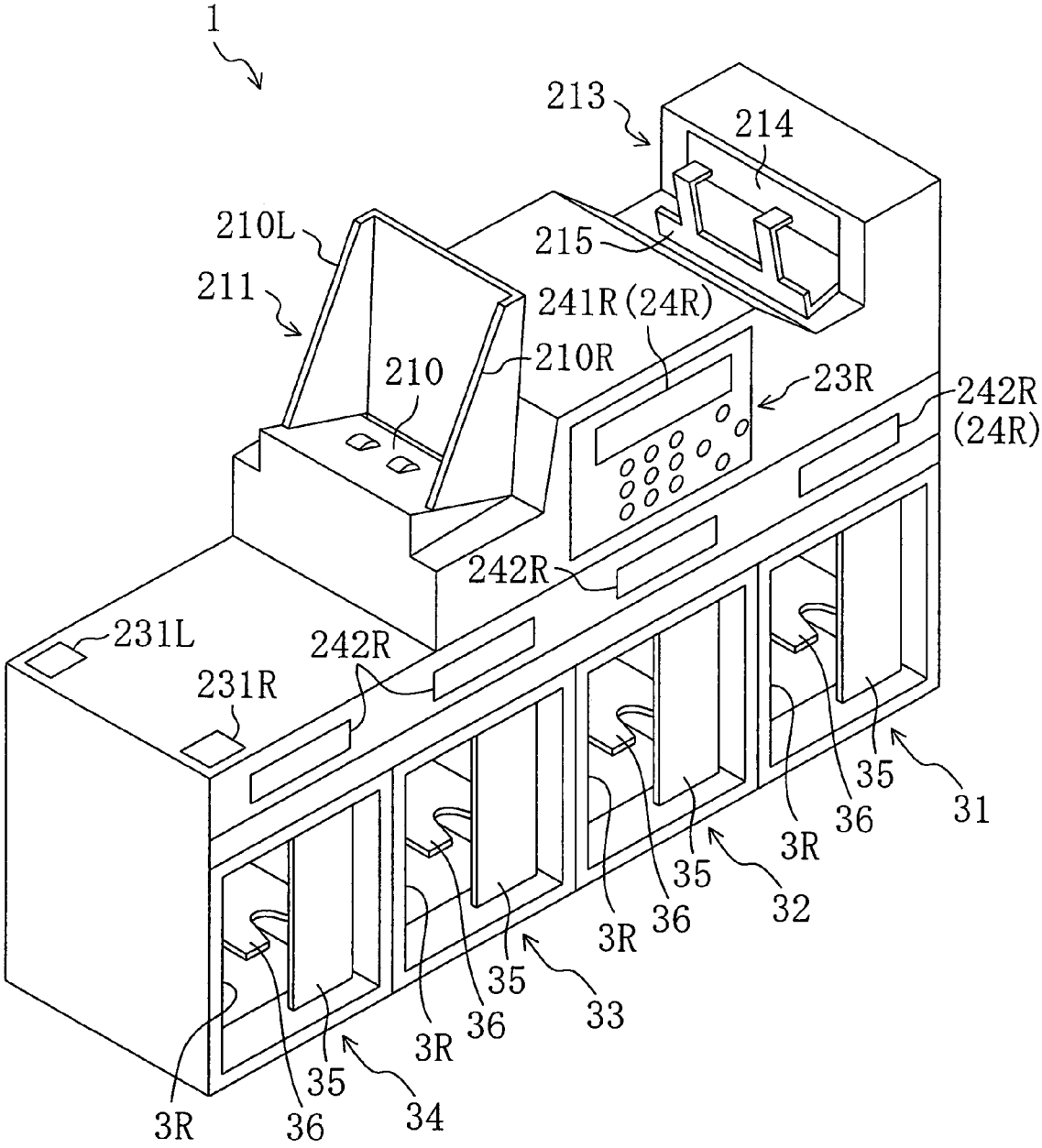
FIG. 2B is an oblique view illustrating the entire structure of the banknote processing machine viewed from the right.

Doors 35 for opening and closing part of the left and right removal openings 3L, 3R are respectively attached to the left removal opening 3L and the right removal opening 3R of each of the stackers 31-34. Each door 35 is pivotally attached to one side of each of the removal openings 3L, 3R and is rotatable about an axis extending in a vertical direction. The doors 35 can switch between the state in which the removal opening is opened as shown in FIG. 2A, and the state in which part of the removal opening is closed as shown in FIG. 2B. When the door 35 is closed, the door 35 interferes with a hand reaching inside the stacking space, which results in restricting the removal of banknotes from the stacking space. On the other hand, when the door 35 is open, the banknotes can be removed from the stacking space. The opening and closing of the doors 35 are controlled by the controller 25 as described later.

The transport unit 4 includes a transport path 41 which connects the inlet unit 211 and the recognition unit 212 to each other, and a transport path 42 which connects the recognition unit 212 and the stacking unit 3 to each other. The reject unit 213 is connected to the transport path 42 via a diverter 43. Further, in the stacking unit 3, each of the first to third stackers 31-33 is connected to the transport path 42 via a diverter 44.

The controller 25 controls the diverter 43 based on the recognition result by the recognition unit 212, thereby transporting unacceptable banknotes, such as unrecognized banknotes and doubly fed banknotes, to the reject unit 213. The controller 25 also controls the diverter 44 based on the recognition result by the recognition unit 212 and the sort configuration, thereby stacking the banknotes in the stackers 31-34.

The structure of the transport unit 4 is not limited to the above structure, but various structures can be applied to the transport unit 4.

The operation unit 23 includes a left operation unit 23L which is located on the left side face of the casing, as shown in FIG. 2A, for performing various operations relating to the processing machine 1, and a right operation unit 23R located on the right side face of the casing, as shown in FIG. 2B, for performing various operations relating to the processing machine 1.

Further, the left operation unit 23L includes a left occupying switch 231L, which is located at a left edge portion of the upper face of the casing that is on the front side, whereas the right operation unit 23R includes a right occupying switch 231R, which is located at a right edge portion of the upper face of the casing that is on the front side. The processing machine 1 is shared for use by two tellers, but cannot be used by the two teller at the same time. The left occupying switch 231L and the right occupying switch 231R are the switches that are used when the teller on the left side or on the right side uses the processing machine 1. The teller on the left side is allowed to use the processing machine 1 when the left occupying switch 231L is operated, whereas the teller on the right side is allowed to use the processing machine 1 when the right occupying switch 231R is operated. These operations for occupation may be performed by the teller terminal 6 as well.

Further, the display unit 24 includes a left display unit 24L which is located on the left side face of the casing, as shown in FIG. 2A, for displaying various information relating to the processing machine 1, and a right display unit 24R which is located on the right side face of the casing, as shown in FIG. 2B, for displaying various information relating to the processing machine 1.

The left display unit 24L includes a display unit 241L for left side operation which is located close to the left operation unit 23L and which displays information relating to operations etc., and display units 242L for left removal openings which are located above the left removal openings 3L of the stackers 31-34 and which display, for example, the number of banknotes stacked in the stackers. On the other hand, the right display unit 24R includes a display unit 241R for right side operation which is located close to the right operation unit 23R and which displays information relating to operations etc., and display units 242R for right removal openings which are located above the right removal openings 3R of the stackers 31-34 and which display, for example, the number of banknotes stacked in the stackers.

As described earlier, the processing machine 1 is configured such that the hopper 210 and the outlet 214 are positioned at locations in the middle of the width dimension, and such that the left operation unit 23L and the left display unit 24L are located on the left side face of the casing, and the right operation unit 23R and the right display unit 24R are located on the right side face of the casing. As shown in FIG. 3, the appearance of the processing machine 1 is symmetrical. Thus, the usability of the processing machine 1 is the same for both of the tellers on the left and right sides of the processing machine 1, and the processing machine 1 is easy to use for both of the tellers.

The locations of the left operation unit 23L and the left display unit 24L are not limited to the left side face of the casing, but may be any locations that are closer to the left in consideration of operability and visibility for the left-side teller. Similarly, the locations of the right operation unit 23R and the right display unit 24R are not limited to the right side face of the casing, but may be any locations that are closer to the right in consideration of operability and visibility for the right-side teller.

Next, a processing operation of the processing machine 1 having the above-described structure will be described. To use the processing machine 1, the teller first operates the occupying switch 231L, 231R (or, the teller operates the teller terminal 6 as described above). If the left occupying switch 231L is operated, the left-side teller occupies the processing machine 1. On the other hand, if the right occupying switch 231R is operated, the right-side teller occupies the processing machine 1. It is thus possible to know, from the operation of these switches, which of the left-side and right-side tellers is to set banknotes in the hopper 210. A signal of the switch operation is sent to the teller terminals 6, 6 via the communication unit 22. The teller terminal 6 of the side occupying the processing machine 1 performs control relating to processing executed by the processing machine 1. The teller terminal 6 of the other side performs control based on the condition that the processing machine 1 cannot be used. In the following description, an example in which the left-side teller occupies the processing machine will be described.

First, the left-side teller sets the configurations of the processing machine 1 by operating the teller terminal 6 or the left operation unit 23L. Specifically, for example, a denomination of banknotes to be stacked in each of the stackers 31-34 is assigned to the stackers 31-34 by designating one by one for each stacker, or by selecting a pattern prepared in advance.

As an example which enables simple configurations of the processing machine 1, client information including such as account numbers may be linked to the configuration information of the processing machine 1, and the information may be stored, for example, in a client information database (not shown) to which the teller terminals 6 are connected. This example enables automatic configurations of the processing machine 1 based on the information in the database, when an account number is input in the teller terminal 6. For example, in some cases, the number of banknotes of only a certain denomination is particularly high, depending on the type of business of the client. In such a case, in the above-mentioned system, the configurations of the processing machine 1 are automatically changed to the configurations suitable for the client by only inputting the account number. For example, the configurations are automatically changed to the configurations in which banknotes of a certain denomination are stacked in two stackers, i.e., the first and second stackers 31, 32, and the banknotes of the other denominations are stacked in the third and fourth stackers 33, 34. As a result, usability is significantly improved.

The technique for identifying a client is not limited to inputting the account number of the client in the teller terminal 6. There exist various known techniques for identifying a client, and those techniques can be appropriately applied to the present invention. For example, a card of the client may be read to identify the client.

Turning to the description of the processing operation of the processing machine 1, the left-side teller places the banknotes in the hopper 210, as well as performs a predetermined process start operation. An occupying switch and a process start switch may be combined so that processing is started upon occupation, or processing may be automatically started simultaneously with the setting of the banknotes.

After the above operation, the banknotes set in the hopper 210 are fed one by one. The fed banknotes reach the recognition unit 212, at which a recognition process and a counting process are performed. Based on the recognition result, acceptable banknotes are transported to the stacking unit 3, whereas unacceptable banknotes are transported to the reject unit 213 to be returned through the outlet 214. After all the banknotes set in the hopper 210 are fed, the banknotes returned to the outlet 214 are again set in the hopper 210 for another recognition process.

The banknotes having reached the stacking unit 3 are selectively transported to and stacked in the stackers 31-34, according to the configurations and the recognition result.

The controller 25 performs control to close the doors 35 of the right removal openings 3R of the stackers 31-34, and performs control to open the doors 35 of the left removal openings 3L, because in this example the left-side teller occupies the processing machine 1 (this is determined based on the operational signal sent by the occupying switches 231L, 231R). Thus, the right-side teller cannot remove the banknotes stacked in the stackers 31-34. Consequently, banknotes are prevented from being erroneously removed by the right-side teller. In other words, errors such as an erroneous removal of banknotes can be avoided in the processing machine 1 shared for use by two tellers on the left and right sides.

On the other hand, the left-side teller can remove the banknotes stacked in the stackers 31-34 through the left removal openings 3L. In other words, the left-side teller removes the banknotes stacked in the stackers 31-34 through the left removal openings 3L, when all the banknotes are fed from the hopper 210 (after completion of reprocessing of the rejected banknotes, if any banknotes are rejected to the reject unit 213) and sorting of the banknotes is finished.

The processing machine 1 may further include a sensor for detecting a removal of banknotes from the stackers 31-34. The processing machine 1 may be configured to determine the completion of a sorting process when the removal of all banknotes from the stackers 31-34 is detected by the sensor. Then, it becomes possible to operate the left or right occupying switch 231L, 231R.

Further, the left-side teller can remove the banknotes stacked in the stackers 31-34 at any time, when any one of the stackers 31-34 is likely to become full during the processing due to processing of a large amount of banknotes. It is thus possible to prevent the stackers from becoming full. As a result, an interruption of the processing resulting from the stackers full of banknotes can be avoided. Even if the stackers become full, the interruption of the processing can be reduced to a minimum, compared to the case where the teller needs to wait until the full stacked banknotes are stored in a storage unit and perform an operation such as opening of the casing, because the banknotes can be easily removed. Thus, in the processing machine 1, an increase in time necessary for the processing is avoided even in the case of processing a large amount of banknotes. As a result, efficiency of the processing can be improved. This can enhance efficiency of work over the counter and reduce the waiting time of clients.

In contrast to the above description, the doors 35 of the right removal openings 3R of the stackers 31-34 are opened, and the doors 35 of the left removal openings 3L are closed, when the right-side teller occupies the processing machine 1. Thus, the right-side teller can remove the banknotes stacked in the stackers 31-34, whereas the left-side teller cannot remove the banknotes stacked in the stackers 31-34.

Structures for restricting a removal of the banknotes from the stacking space are not limited to the above structure. The structure does not have to be the doors located at part of the left removal openings 3L or right removal openings 3R as shown in FIG. 2, but may be a shutter which completely closes each of the removal openings 3L, 3R.

Further, opening and closing of the doors do not have to be controlled by the controller 25, but the doors may be opened and closed manually. In this case, it is preferable that locking/unlocking of the closed doors is controlled by the controller 25, or that a detection sensor for detecting a hand entering in the accumulating space through the left or right removal opening 3L, 3R is attached. With these structures, it is possible to prevent a removal of the banknotes from the stackers, and possible to detect an erroneous removal and give a warning to the teller.

As described above, the processing machine 1 may further include a sensor for detecting a removal of banknotes from each of the stackers 31-34. The detection of a hand entering in the stacking space and the detection of a removal of banknotes may be combined. Further, it is possible to restrict a removal of the banknotes by a teller by using the above-mentioned sensor and a warning based on the detection of the sensor, without attaching the doors 35.

In the above description, the tellers remove the banknotes from the stackers 31-34 after completion of the processing. However, if only a small amount of banknotes is stacked in the stackers 31-34, the banknotes may be stacked in the stacker until a predetermined number of banknotes are stacked in the stackers. In this case, the doors 35 of the left and right removal openings 3L, 3R may be closed, and the doors 35 may be opened (or unlocked) when the predetermined number of banknotes are stacked in the stackers 31-34. With this structure, it is not necessary to remove the banknotes every time the processing is performed. As a result, efficiency of the processing can be further improved.

Figure 6:
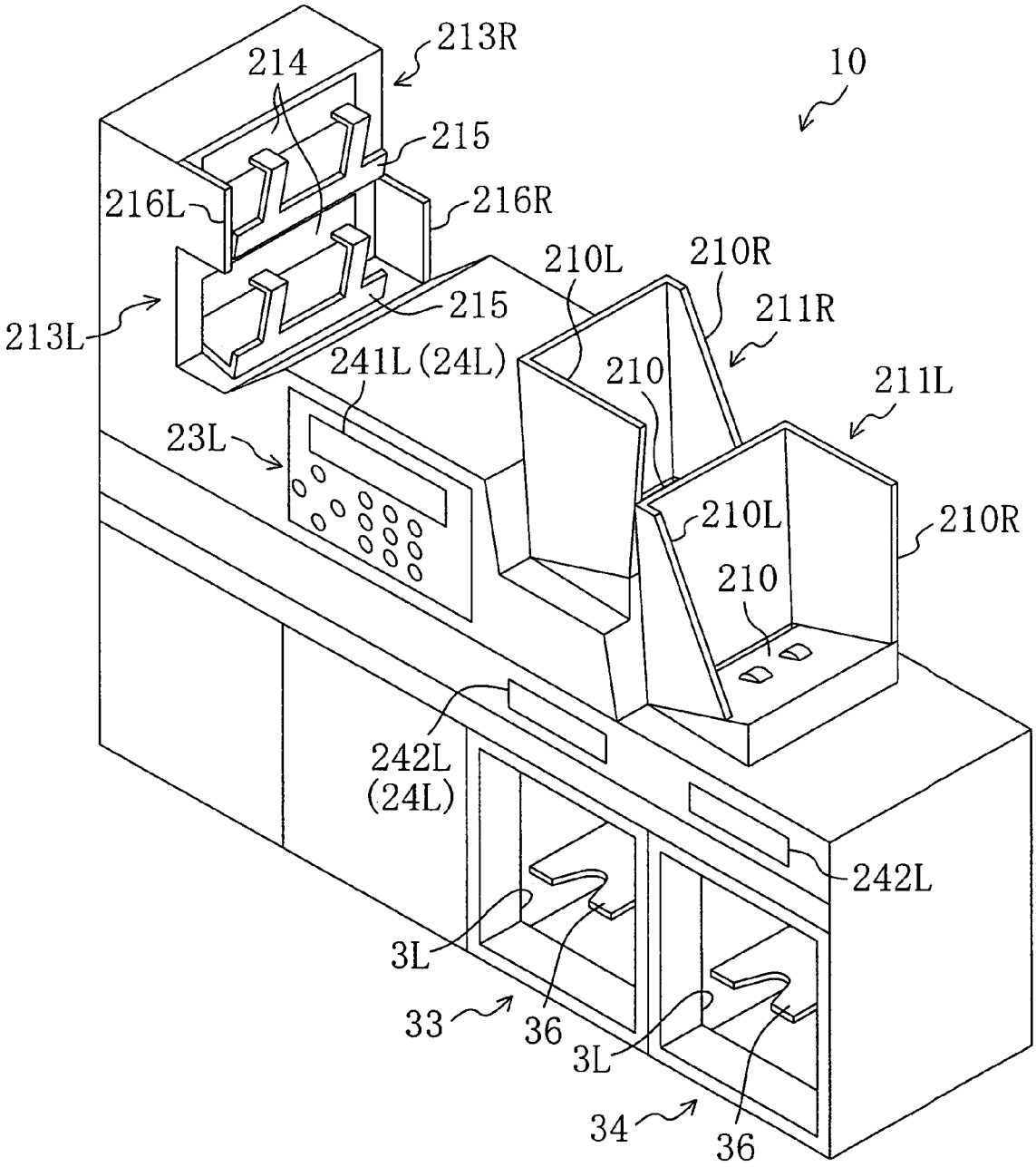
FIG. 6 is an oblique view illustrating another structure of the banknote processing machine viewed from the left.
Figure 7:
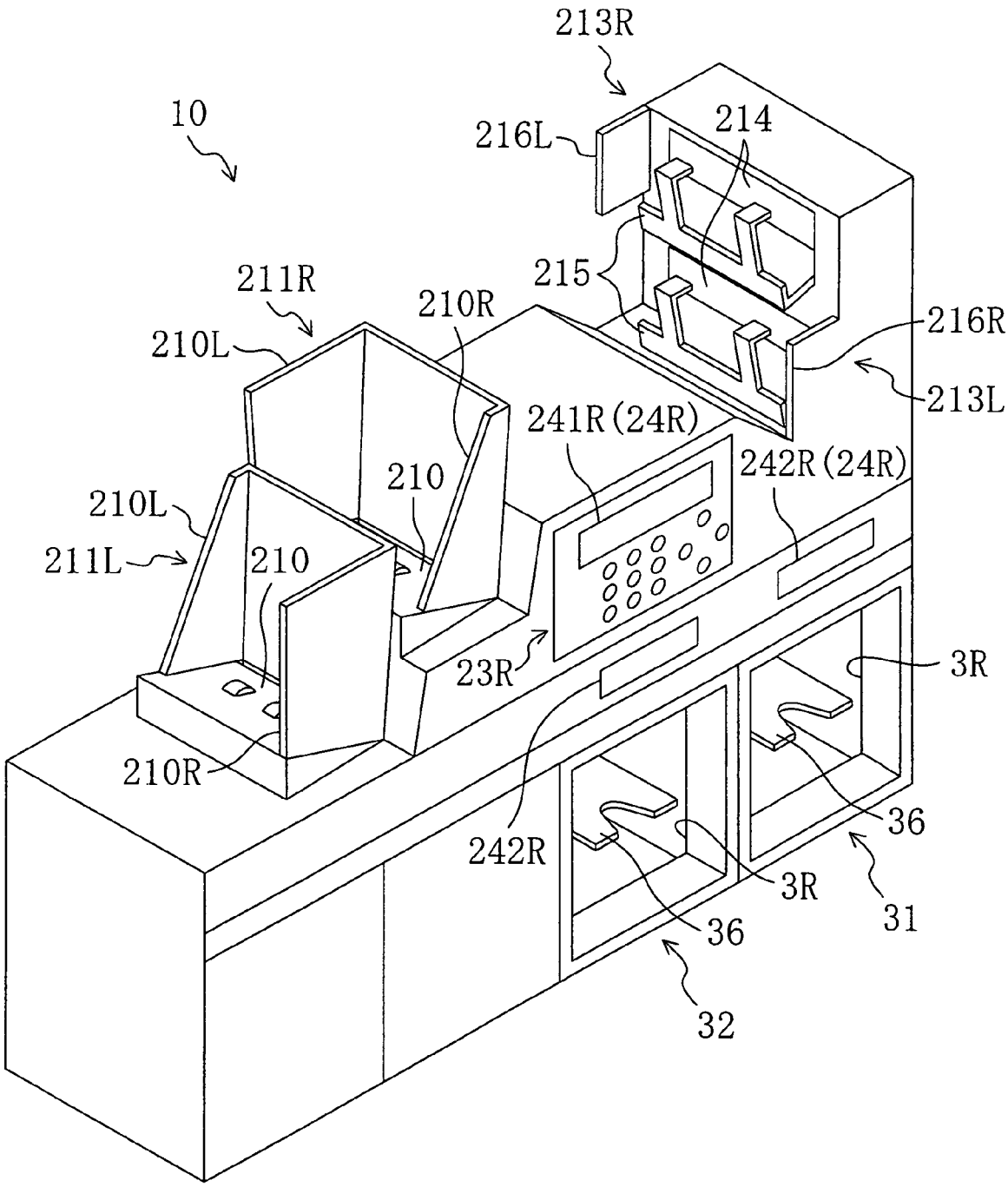
FIG. 7 is an oblique view illustrating another structure of the banknote processing machine viewed from the right.

FIGS. 6 and 7 show a processing machine 10 having a different structure than the above-described structure. The processing machine 10 is configured to include, as an inlet unit, two types of inlet units, i.e., a left inlet unit 211L and a right inlet unit 211R, and include, as a reject unit, two types of reject units, i.e., a left reject unit 213L and a right reject unit 213R. Like reference characters may be used to designate the elements identical to those of the processing machine 1, and explanation thereof may be omitted as appropriate.

In this example, the left inlet unit 211L and the right inlet unit 211R are placed on the upper face of the casing along the length dimension. The left inlet unit 211L is placed at a location that is stepped down from the right inlet unit 211R.

The left inlet unit 211L is configured such that the left side wall 210L of the guide plate is diagonally cut, whereas the right side wall 210R of the guide plate is not cut. This structure allows banknotes to be set in the left inlet unit 211L from the left, and prevents the setting of the banknotes from the right.

In contrast, the right inlet unit 211R is configured such that the left side wall 210L is not cut, whereas the right side wall 210R is diagonally cut. This structure allows the setting of banknotes in the right inlet unit 211R from the right, and prevents the setting of the banknotes from the left.

In this example, the left reject unit 213L and the right reject unit 213R are placed at a rear portion of the upper face of the casing, and are vertically stacked to each other, with right reject unit 213R being above the left reject unit 213L.

At a right side portion of the left reject unit 213L, an interference wall 216R which extends to face the right side is provided. The left reject unit 213L is configured such that a removal of banknotes from the right side is prevented by the interference wall 216R. No interference wall is provided at a left side portion of the left reject unit 213L, and therefore, the banknotes can be removed from the left side.

In contrast, at a left side portion of the right reject unit 213R, an interference wall 216L which extends to face the left side is provided. The right reject unit 213R is configured such that a removal of banknotes from the left side is prevented by the interference wall 216L, but that a removal of the banknotes from the right side is possible.

Further, each reject unit may be configured to have a cylindrical shape as the stackers have, thereby preventing an erroneous removal of banknotes more reliably.

In the processing machine 10, the stacking unit 3 includes first to fourth stackers 31-34. This structure is the same as the structure of the processing machine 1. However, of the first to fourth stackers 31-34, the first and second stackers 31, 32 include only right removal openings 3R which are open to the right side of the casing, whereas the third and fourth stackers 33, 34 include only left removal openings 3L which are open to the left side of the casing. In other words, the stacking unit 3 is configured to include a stacking unit of a first type which includes only the left removal openings 3L, and a stacking unit of a second type which includes only the right removal openings 3R. The left-side teller cannot remove the banknotes stacked in the first and second stackers 31, 32, but can remove the banknotes stacked in the third and fourth stackers 33, 34. In contrast, the right-side teller can remove the banknotes stacked in the first and second stackers 31, 32, but cannot remove the banknotes stacked in the third and fourth stackers 33, 34. No shutter is provided in the processing machine 10, but a shutter may be provided to each of the removal openings 3L, 3R in the processing machine 10 as well.

The number of stackers included in the processing machine 10 is not specifically limited, as is the case with the above-described structure.

In the processing machine 10, the left-side teller sets the banknotes in the left inlet unit 211L, and the right-side teller sets the banknotes in the right inlet unit 211R. The configurations of the processing machine 10 are set by operating the teller terminals 6 or the operation units 23L, 23R. This structure is the same as the structure of the processing machine 1. As described earlier, the structure is the same as the above-described structure in that it is possible to perform control by linking client information, such as account numbers, with configuration information of the processing machine 10.

An operation of the processing machine 10 will be described. In this example, the left-side teller occupies the processing machine 10. The left-side teller performs a predetermined process start operation, and thereby, the banknotes set in the left inlet unit 211L are fed one by one. The fed banknotes reach the recognition unit 212, at which a recognition process and a counting process are performed. Based on the recognition result, processable banknotes are transported to the stacking unit 3, whereas unprocessable banknotes are transported to the left reject unit 213L and returned through the outlet 214. As mentioned earlier, the left-side teller can remove the banknotes in the left reject unit 213L, whereas the right-side teller cannot remove the banknotes. This results in preventing an erroneous removal of banknotes.

The banknotes having reached the stacking unit 3 are transported to and stacked in the third or fourth stacker 33, 34 according to the sort configurations and the recognition result. Then, the left-side teller can remove the banknotes stacked in the stackers 33, 34. On the other hand, the banknotes stacked in the third or fourth stacker 33, 34 are prevented from being removed by the right-side teller, as mentioned above.

When the third or fourth stacker 33, 34 is likely to become full, or when the third or fourth stacker 33, 34 has become full, the left-side teller removes the banknotes from there, thereby making it possible to continue the process without interruption, or even if an interruption occurs, it is possible to easily restart the process and reduce the interruption to a minimum, as described above.

In contrast, in the case where the right-side teller occupies the processing machine 10, the right-side teller performs a predetermined process start operation. The banknotes set in the right inlet unit 211R are thereby fed one by one, and are subjected to a recognition process and a counting process in the recognition unit 212. Based on the recognition result, processable banknotes are transported to the stacking unit 3, whereas unprocessable banknotes are transported to the right reject unit 213R and returned through the outlet 214.

The banknotes transported to the stacking unit 3 are transported to and stacked in the first or second stacker 31, 32 according to the sort configurations and the recognition result. Then, the right-side teller can remove the banknotes stacked in the stackers 31, 32. On the other hand, the banknotes stacked in the stackers 31, 32 are prevented from being removed by the left-side teller.

In this case, when the first or second stacker 31, 32 is likely to become full, or when the first or second stacker 31, 32 has become full, the right-side teller removes the banknotes whenever necessary, thereby making it possible to continue the process without interruption, or even if an interruption occurs, it is possible to easily restart the process and reduce the interruption to a minimum, as described above.

As described above, the processing machine 10 can be shared for use by two tellers, and an erroneous removal of the banknotes can be avoided, also in the case where the processing machine 10 is configured to include two types of units, i.e., one dedicated to the left side and the other dedicated to the right side, for each of the inlet unit 211, the reject unit 213, and the stacking unit 3.

Providing two types of inlet units enables the following control. Suppose that the right-side teller sets banknotes in the right inlet unit 211R, and performs a process start operation, while the left-side teller is using the processing machine 10. In this case, the right-side process may be postponed until the left-side process is finished, and may be automatically started when the left-side process is finished.

Any one or two of the inlet unit 211, the reject unit 213, and the stacking unit 3 may include two types of units, left and right, as described above. The other unit(s) may include one type of unit like the processing machine 1 shown in FIGS. 1 and 2.

Specifically, the structure may be such that: (a) inlet unit 211 includes one type of unit, and each of the reject unit 213 and the stacking unit 3 includes two types of units; (b) the reject unit 213 includes one type of unit, and each of the inlet unit 211 and the stacking unit 3 includes two types of units; (c) the stacking unit 3 includes two types of units, and each of the inlet unit 211 and the reject unit 213 includes one type of unit; (d) each of the inlet unit 211 and the reject unit 213 includes one type of unit, and the stacking unit 3 includes two types of units; (e) each of the reject unit 213 and the stacking unit 3 includes one type of unit, and the inlet unit 211 includes two types of units; or (f) each of the inlet unit 211 and the stacking unit 3 includes two types of units, and the reject unit 213 includes one type of unit.

Here, the above-mentioned automatic starting control for the processing machine 10 in which the inlet unit includes two types of units, and at least the stacking unit 3 includes one type of unit, will be described. In this case, if the next process is automatically started with banknotes stacked in the stacking unit 3 (a stacker), banknotes relating to a right-side process and banknotes relating to a left-side process may be mixed in the stacker. Thus, it is preferable that the start of the process is triggered by the fact that all banknotes are removed from each stacker. Thus, a sensor for detecting that all banknotes are removed from each stacker may be attached.

The above sorters 1, 10 do not have to be placed at a teller counter. For example, the above sorters 1, 10 may be placed between the teller counter and a back office, and may be shared for use by a person operating at the teller counter and a person operating at the back office.

Further, paper sheet handling apparatuses to which the present invention is applicable are not limited to processing machines, but the present invention is applicable, for example, to recognition machines which recognize between fit paper sheets and unfit paper sheets, and other apparatuses. The recognition unit may perform only a recognition process or perform only a counting process, or perform both of the recognition process and the counting process, according to the apparatus type.

INDUSTRIAL APPLICABILITY

As described above, an apparatus according to the present invention can be shared for use by operators on both sides of the casing. Thus, the present invention is useful, for example, as a processing machine, a recognition machine for recognizing between fit paper sheets and unfit paper sheets, and other paper sheet handling apparatuses. Moreover, aspects of the present invention are applicable in coin handling apparatuses.

The invention claimed is:

1. A paper sheet handling apparatus, comprising:

a casing which includes a first face and a second face opposed to the first face;

a receiving unit which includes an inlet for receiving the paper sheets, and a feed mechanism for feeding the paper sheets received in the inlet, one by one;

a recognition unit for performing at least one of a counting process and a recognition process with respect to each of the paper sheets received in the receiving unit;

at least two stacking units for stacking the paper sheets that have been processed by the recognition unit;

a transport unit for transporting the paper sheets among the receiving unit, the recognition unit and the stacking units; and a controller for controlling each of the units so that each of the paper sheets is selectively stacked in the at least two stacking units at least according to differences in denominations and/or whether the paper sheets are fit or unfit, wherein each stacking unit is configured to include a partition wall for separating a stacking space in which the paper sheets are stacked from the other stacking units, and at least two paper sheet removal openings which are open in the first face and the second face, respectively, the stacking space is connected to both of the paper sheet removal opening in the first face and the paper sheet removal opening in the second face, and the paper sheets in the stacking space are allowed to be removed from both of the first face side and the second face side of the casing through the paper sheet removal openings, wherein the stacking units are configured such that paper sheets can be removed from each of the paper sheet removal openings at the same time.

2. The paper sheet handling apparatus of claim 1, further comprising:

a restriction mechanism for restricting a direction of removal of the paper sheets in the stacking units, to a direction from the first face side or a direction from the second face side.

3. The paper sheet handling apparatus of claim 2, further comprising:

an instruction mechanism for instructing whether the direction of removal of the paper sheets in the stacking units is from the first face side or from the second face side, wherein according to a result of the instruction from the instruction mechanism, the paper sheets are allowed to be removed from the side that has been instructed.

4. The paper sheet handling apparatus of claim 2, wherein the receiving unit includes a receiving part for the first face side and a receiving part for the second face side, and the paper sheets received in the receiving part for the first face side are allowed to be removed from the first face side, and the paper sheets received in the receiving part for the second face side are allowed to be removed from the second face side.

5. The paper sheet handling apparatus of claim 1, further comprising an operation unit for the first face side and an operation unit for the second face side.

6. The paper sheet handling apparatus of claim 1, further comprising a display unit for the first face side and a display unit for the second face side.

* * * * *